US008002152B2

(12) United States Patent
Margheritis et al.

(10) Patent No.: US 8,002,152 B2
(45) Date of Patent: Aug. 23, 2011

(54) FLUID PRODUCT DISPENSING DEVICE

(75) Inventors: Antonio Margheritis, Cittiglio (IT); Alessio Mariotti, Vernate (IT)

(73) Assignee: Valois SAS, Le Neubourg (FR)

( * ) Notice: Subject to any disclaimer, the term of this patent is extended or adjusted under 35 U.S.C. 154(b) by 1071 days.

(21) Appl. No.: 10/586,336

(22) PCT Filed: Jan. 14, 2005

(86) PCT No.: PCT/FR2005/050022

§ 371 (c)(1),
(2), (4) Date: Mar. 16, 2007

(87) PCT Pub. No.: WO2005/073093

PCT Pub. Date: Aug. 11, 2005

(65) Prior Publication Data

US 2007/0158369 A1 Jul. 12, 2007

(30) Foreign Application Priority Data

Jan. 16, 2004 (FR) ..... 04 00397

(51) Int. Cl.
*B05B 11/00* (2006.01)

(52) U.S. Cl. ..... 222/321.9; 222/321.1; 222/542; 215/345; 215/DIG. 1

(58) Field of Classification Search ..... 222/321.1, 222/321.7–321.9, 341, 383.1, 385, 402.1, 222/402.13, 542; 239/333; 215/341, 343–345, DIG. 1

See application file for complete search history.

(56) References Cited

U.S. PATENT DOCUMENTS

| | | | | |
|---|---|---|---|---|
| 3,180,534 | A | 4/1965 | Duda et al. | |
| 3,897,006 | A * | 7/1975 | Tada | 239/333 |
| 4,461,393 | A * | 7/1984 | Dutt | 215/329 |
| 5,108,013 | A | 4/1992 | VanBrocklin | |
| 6,053,371 | A * | 4/2000 | Durliat et al. | 222/321.9 |
| 6,672,488 | B2 * | 1/2004 | de Pous | 222/321.9 |

FOREIGN PATENT DOCUMENTS

| | | |
|---|---|---|
| EP | 0 343 414 A2 | 11/1989 |
| EP | 0 806 248 A1 | 11/1997 |

* cited by examiner

*Primary Examiner* — J. Casimer Jacyna
(74) *Attorney, Agent, or Firm* — Sughrue Mion, PLLC

(57) ABSTRACT

A fluid dispenser device comprising a dispenser member (10), such as a pump or a valve, a fluid reservoir (30), and a fastener element (20) for fastening said dispenser member (10) onto a neck (35) of said reservoir (30), a turret (40) being disposed between the body (11) of the dispenser member (10) and said fastener element (20), said turret (40) including a deformable radial flange (45), said deformable radial flange including deformable sealing means (46, 47) projecting from said radial flange (45), said radial flange (45), after assembly, being deformed and co-operating in leaktight manner with the top edge of the neck (35) of the reservoir (30), and said sealing means (46, 47), after assembly, being deformed and co-operating in leaktight manner with said fastener element (20).

8 Claims, 1 Drawing Sheet

FLUID PRODUCT DISPENSING DEVICE

BACKGROUND OF THE INVENTION

1. Field of the Invention

The present invention relates to a fluid dispenser device, and more particularly to such a device including a pump.

2. Description of Related Art

Fluid dispenser devices are well known in the state of the art. They are used in particular for dispensing fluids, e.g. liquids, pastes, gases, or powders, from a reservoir by means of a dispenser member such as a pump or a valve. The dispenser member is generally fastened onto the reservoir by means of a fastener element, e.g. a snap-fastener ring or the like. In order to ensure that the fastening is leaktight, a neck gasket is generally disposed between the top edge of the neck of the reservoir and the fastener element, the neck gasket generally being made of elastomer material in order to provide sealing. In order to provide good sealing, the gasket should be compressed neither too much, nor too little, and in particular in the context of a snap-fastenable ring, sealing problems can occur, e.g. because of manufacturing tolerances, i.e. dimensional and/or geometrical variations in the various component parts of the device, and in particular in the neck of the reservoir. In addition, the use of a snap-fastenable ring and of a conventional neck gasket does not enable the device to be adapted to different configurations or topographies of the reservoir neck, and consequently would require a specific device to be made for each type of reservoir neck.

SUMMARY OF THE INVENTION

An object of the present invention is to provide a fluid dispenser device that does not have the above-mentioned drawbacks.

More particularly, an object of the present invention is to provide a fluid dispenser device that ensures good leaktightness where the dispenser member is fastened on the neck of the reservoir, and does so regardless of the possible dispersion in the manufacturing tolerances of the various component parts of the device.

Another object of the present invention is to provide a fluid dispenser device that ensures sealing, while adapting to different topographies of the reservoir neck, without having to modify the component elements of the invention.

Another object of the present invention is to provide fluid dispenser device that is simple and inexpensive to manufacture and to assemble.

The present invention thus provides a fluid dispenser device comprising a dispenser member, such as a pump or a valve, a fluid reservoir, and a fastener element for fastening said dispenser member onto a neck of said reservoir, a turret being disposed between the body of the dispenser member and said fastener element, said turret including a deformable radial flange, said deformable radial flange including deformable sealing means projecting from said radial flange, said radial flange, after assembly, being deformed and co-operating in leaktight manner with the top edge of the neck of the reservoir, and said sealing means, after assembly, being deformed and co-operating in leaktight manner with said fastener element.

Advantageously, said turret is fastened firstly to said body of the dispenser member, and secondly to said fastener element, in particular by snap-fastening.

Advantageously, before assembly, said radial flange curves upwards.

Advantageously, after assembly, said radial flange is flat between the fastener element and the neck of the reservoir.

Advantageously, said radial flange includes two projections forming said deformable sealing means, said projections extending, before assembly, axially and parallel to each other.

Advantageously, after assembly, the two projections form an angle relative to each other.

Advantageously, said fastener element includes an approximately cone-shaped profile, said deformable sealing means of said turret co-operating in the mounted state with said approximately cone-shaped profile.

Advantageously, after assembly, the two projections co-operate in leaktight manner with said approximately cone-shaped profile, the tip of the cone being disposed between said two projections.

Advantageously, said dispenser member is a pump comprising a pump body, and an actuator rod that is secured to a piston and that is displaceable relative to said pump body, said turret co-operating in leaktight manner with said actuator rod.

Advantageously, said fastener element includes fastener means, in particular snap-fastener means, for being fastened, in particular snap-fastened, onto the neck of the reservoir.

Advantageously, the deformable radial flange of the turret forms at least one sealing zone with the neck of the reservoir, and at least two sealing zones with the fastener element.

Advantageously, the deformable radial flange of the turret forms a single sealing zone with the neck of the reservoir, and three sealing zones with the fastener element.

BRIEF DESCRIPTION OF THE DRAWINGS

Other characteristics and advantages of the present invention appear more clearly from the following detailed description, given by way of non-limiting example, and with reference to the accompanying drawing, and in which.

DETAILED DESCRIPTION OF THE INVENTION

Figure 3:
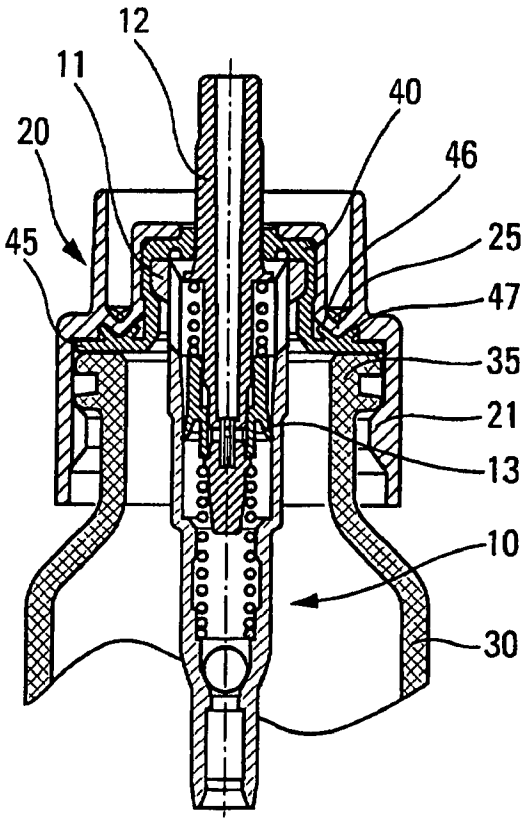
FIG. 3 is a view similar to the view in FIG. 2, showing assembly on another type of reservoir neck.

With reference to the figures, the fluid dispenser device of the invention includes a dispenser member 10, which, in the example shown, is a pump 10, but which could naturally also be made in the form of a valve. The pump 10 comprises a pump body 11 in which there slides an actuator rod 12 that is secured to a piston 13, but naturally the structure and the functioning of the pump could be of any kind, the structure and functioning not being involved directly in the present invention. The pump is therefore not described more fully below, and the embodiment shown in the drawing is given only by way of non-limiting illustration for the invention.

Figure 2:
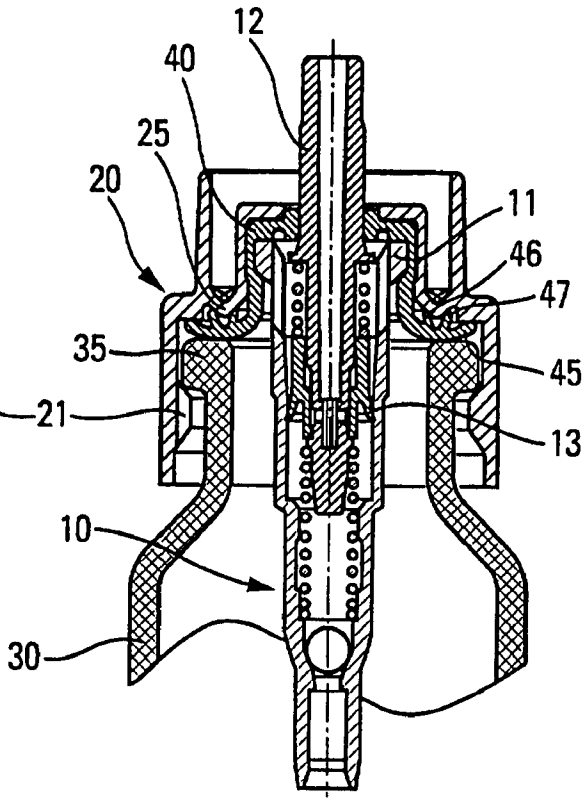
FIG. 2 is a view similar to the view in FIG. 1, showing an assembled position on a first type of reservoir neck.

In conventional manner, a fastener element 20 is provided for fastening the pump 10 onto the reservoir 30, as can be seen in FIGS. 2 and 3. The fastener element 20 can be made in the form of a snap-fastenable ring that includes fastener means 21 made in the form of a snap-fastener profile for snap-fastening on the neck 35 of the reservoir 30, as shown in FIGS. 2 and 3, which show the device in its assembled position. The snap-fastener profile 21 can be formed by an elastically deformable structure, but any other snap-fastener structure could be envisaged, e.g. snap-fastener tabs. In addition, the fastener element 20 is not necessarily a snap-fastenable ring, but could be made in any desired way, e.g. in the form of a ring that can be screw-fastened, clamped, or the like.

In the invention, a turret 40 is interposed between the fastener element 20 and the pump body 11. In particular, the turret 40 can be snap-fastened on the top edge of the pump body 11, the fastener element 20 itself then being snap-fastened on said turret, as shown in the figures. Other means for fastening the turret 40 to the pump body 11, and for fastening the fastener element 20 to the turret 40 could naturally be envisaged. The turret includes a deformable radial flange 45 that extends between the top edge of the neck 35 of the reservoir 30, and an approximately radial portion of the fastener element 20. After assembly, it is the radial flange 45 of the turret 40 that seals the fastening on the neck 35 of the reservoir. It therefore replaces the usual neck gasket, and the radial flange is therefore preferably made of a material that is suitable for providing sealing, e.g. an elastomer material. As can be seen in the figures, the radial flange 45 includes deformable sealing means 46, 47 that project from said radial flange, and that, after assembly, co-operate in leaktight manner with the fastener element 20. Thus, the radial flange 45 itself forms the sealing with the top edge of the neck 35 of the reservoir 30, and the deformable sealing means 46, 47 form the sealing with the fastener element 20.

Figure 1:
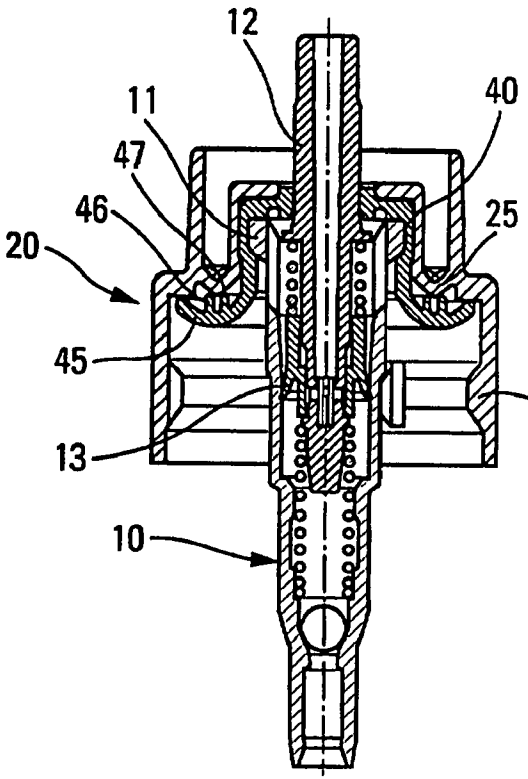
FIG. 1 is a diagrammatic section view of a portion of a fluid dispenser device, before being assembled on a reservoir.

Before assembly, the radial flange 45 advantageously curves upwards, as can be seen in FIG. 1. This particular structure makes it possible for the device of the invention to be able not only to compensate for dispersion in the manufacturing tolerances of the various component elements of the device, but also to adapt to different configurations for the neck of the reservoir, as can be seen in particular in FIGS. 2 and 3. The curved shape of the radial flange 45 enables it to adapt to dimensional variations during assembly, this compensation of dimensional variations being obtained not only by the deformable character of the material itself, but especially by the curved structure of the radial flange 45. With reference to FIGS. 2 and 3, it should be observed that in FIG. 2, the neck 35 of the reservoir has an axial dimension that is smaller than that of the neck shown in FIG. 3. The assembled position shown in FIG. 2 shows a radial flange 45, which, in comparison to the initial shape shown in FIG. 1, is flat between the top edge of the neck 35 and the fastener element 20, but the radial flange is not completely plane, which shows that there remains some margin in the embodiment in FIG. 2. In contrast, in the embodiment in FIG. 3, in which the dimension of the neck 35 is greater, snap-fastening the fastener element 20 on the neck of the reservoir causes the radial flange 45 to be completely flattened, as shown clearly in this figure.

The deformable sealing means 46, 47 are preferably made in the form of two projections, which, in the before-assembly position, advantageously extend axially and parallel to each other. The fastener element 20 advantageously includes an approximately cone-shaped profile 25 for co-operating with the two projections 46, 47 of the turret 40. As can be seen in FIGS. 2 and 3, the approximately cone-shaped profile 25 of the fastener element 20 comes between said projections 46, 47 during assembly and moves them apart, such that the two projections 46, 47 form an angle relative to each other in the assembled position. The tip of the cone of the approximately cone-shaped profile 25 is thus disposed between the two projections, and sealing is therefore provided on both sides of said tip of the cone. Once again, FIGS. 2 and 3 show that this structure also makes it possible to adapt to various snap-fastener dimensions, the cone 25 of the fastener element penetrating to a greater or lesser extent between the two projections 46, 47, depending on the dimension of the neck of the reservoir.

A particular advantage of the present invention is that it guarantees sealing even when the radial flange 45 is not completely flat between the fastener element and the top edge of the neck of the reservoir (i.e. in the position in FIG. 2, in which it should be observed that the radial flange also curves a little even after assembly). The curved shape of the radial flange 45 guarantees at least one sealing zone between the radial flange 45 and the top edge of the neck of the reservoir, and at least two sealing zones, and preferably three, between said radial flange and the fastener element 20. In the embodiment shown in the drawing, and in particular in FIG. 2, the radial flange 45 forms three sealing points with the fastener element 20, namely the two projections 46, 47, and the outer radial end of the radial flange 45 that also co-operates in leaktight manner with a portion of the fastener element 20.

Advantageously, the turret 40 also co-operates in leaktight manner with the actuator rod 12 of the pump, such that the turret 40 ensures safe, reliable, and leaktight operation of the dispenser device as a whole.

The present invention therefore enables a dispenser device to be made that makes it possible to adapt to reservoir necks of different shapes and topographies, and to compensate for dispersion in manufacturing tolerances, which avoids having to modify the device, while guaranteeing leaktightness in any situation. The present invention therefore makes it possible to make, in simple and inexpensive manner, a system that is versatile and transposable to different situations.

Although the invention is described with reference to particular embodiments thereof, it is naturally not limited to the embodiments shown or described. On the contrary, any useful modifications could be applied thereto by a person skilled in the art, without going beyond the ambit of the present invention, as defined by the accompanying claims.

The invention claimed is:

1. A fluid dispenser device comprising:

a dispenser member (10);

a fluid reservoir (30);

a fastener element (20) for fastening said dispenser member (10) onto a neck (35) of said reservoir (30); and a turret (40) disposed between a body (11) of the dispenser member (10) and said fastener element (20), wherein said turret (40) includes a deformable radial flange (45), said deformable radial flange having deformable sealing means (46, 47) projecting from said radial flange (45), wherein said radial flange (45), before assembly, curves upwards, and after assembly, is deformed and co-operates in leaktight manner with the top edge of the neck (35) of the reservoir (30) so that said radial flange (45) is radially flat between, and in contact with, the fastener element (20) and the neck (35) of the reservoir (30), and said sealing means (46, 47), after assembly, is also deformed and co-operates in leaktight manner with said fastener element (20)

wherein said deformable sealing means includes two projections (46, 47) extending, before assembly, axially and parallel to each other, wherein said fastener element (20) includes an approximately cone-shaped profile (25), and after assembly, the two projections (46, 47) co-operate in leaktight manner with said approximately cone-shaped profile (25), the tip of the cone being disposed between said two projections (46, 47).

2. A device according to claim 1, in which said turret (40) is fastened firstly to said body (11) of the dispenser member (10), and secondly to said fastener element (20) by snap-fastening.

3. A device according to claim 1, in which, after assembly, the two projections (46, 47) form an angle relative to each other.

4. A device according to claim 1, in which said dispenser member (10) is a pump comprising a pump body (11), and an actuator rod (12) that is secured to a piston (13) and that is displaceable relative to said pump body (11), said turret (40) co-operating in leaktight manner with said actuator rod (12).

5. A device according to claim 1, in which said fastener element (20) includes snap-fastener means, for snap fastening onto the neck (35) of the reservoir (30).

6. A fluid dispenser device comprising:

a dispenser member (10);

a fluid reservoir (30);

a fastener element (20) for fastening said dispenser member (10) onto a neck (35) of said reservoir (30); and a turret (40) disposed between a body (11) of the dispenser member (10) and said fastener element (20), wherein said turret (40) includes a deformable radial flange (45), said deformable radial flange having deformable sealing projections (46, 47) that extend upwards from said radial flange (45), wherein said radial flange (45), before assembly, curves upwards, and after assembly, has a deformed flattened shape which co-operates in a leaktight manner with the top edge of the neck (35) of the reservoir (30) so that said radial flange (45) is in contact with the fastener element (20) and the neck (35) of the reservoir (30), and said sealing projections (46, 47), after assembly, are also deformed and co-operate in a leaktight manner with said fastener element (20), wherein the deformable radial flange (45) of the turret (40) forms at least one sealing zone with the top edge of the neck (35) of the reservoir (30), and said sealing projections form two sealing zones with the fastener element (20), wherein the deformable sealing projections (46, 47) extend, before assembly, axially and parallel to each other, wherein the fastener element (20) includes an approximately cone-shaped profile (25), and after assembly, the two projections (46, 47) co-operate in leaktight manner with the approximately cone-shaped profile (25), the tip of the cone being disposed between the two projections (46, 47).

7. A device according to claim 6, wherein an outer radial end of the deformable radial flange (45) of the turret (40) forms a third sealing zone with the fastener element (20).

8. A device according to claim 1, wherein the deformable radial flange (45) is completely flattened between the top edge of the neck (35) and the fastener element (20) after assembly.

* * * * *